United States Patent [19]

Ferris

[11] 4,040,176

[45] Aug. 9, 1977

[54] METHOD FOR MANUFACTURING INSULATED GROUNDING STRAPS

[75] Inventor: Robert C. Ferris, Chicago, Ill.

[73] Assignee: Christiana Industries Corporation, Chicago, Ill.

[21] Appl. No.: 695,116

[22] Filed: June 11, 1976

[51] Int. Cl.[2] ..... H01B 13/06

[52] U.S. Cl. ..... 29/624; 29/630 R; 81/9.5 R

[58] Field of Search ..... 29/624, 427, 426, 629, 29/630 R; 81/9.51, 9.5 R; 339/28, 29 R, 29 B, 17 R, 17 F, 224, 277, 275 RB, 276 RB; 174/69, 72 R, 72 TR, 117 R, 117 F, 117 FF, 126 R

[56] References Cited

U.S. PATENT DOCUMENTS

| | | | |
|---|---|---|---|
| 2,963,392 | 12/1960 | Dahlgren | 339/17 F |
| 3,239,916 | 3/1966 | Love | 29/624 X |
| 3,261,239 | 7/1966 | Moons et al. | 81/9.51 |
| 3,636,623 | 1/1972 | Paine et al. | 29/624 |

*Primary Examiner*—Victor A. DiPalma

*Attorney, Agent, or Firm*—McDougall, Hersh & Scott

[57] ABSTRACT

A method is disclosed for manufacturing insulated grounding straps of the type used for grounding a television chassis. The straps are produced from a continuous length of insulated flat strip conductor. Holes are punched on either side of a severing point selected according to the desired length of the strap. The continuous length is then severed between the holes and the insulation removed near the ends of the severed lengths.

2 Claims, 2 Drawing Figures

METHOD FOR MANUFACTURING INSULATED GROUNDING STRAPS

BACKGROUND OF THE INVENTION

This invention relates to the field of producing electrical conductors. Specifically, it relates to the field of producing grounding straps of the type used in consumer electronic products, such as, televisions, radios, and the like. Such grounding straps are usually formed from a flexible conductive metal and are insulated over their length with the exception of their ends which are exposed for connection between a television chassis and a frame or other structure. Typically, these grounding straps are flat elongated conductors of a selected length according to the specific use for which they are employed. In order to meet electrical and fire codes and to be certified by the Underwriters testing organization, these straps must be insulated over a substantial portion of their length. Such insulation usually takes the form of a nonconducting sleeve of polyvinyl chloride, polyethylene, or the like.

The usual method of producing such grounding straps is to produce the conductors of a desired length and then manually place an insulating sleeve over the conductor. This is a slow and labor intensive process resulting in a high cost to produce a relatively small component.

It is accordingly an object of the invention to provide a method for producing grounding straps which substantially avoids the need for manual assembly.

It is another object of the invention to produce grounding straps by utilizing a continuous flat insulated conductor which is then cut to a desired length and stripped.

Another object of the invention is to provide a method for producing grounding straps which are stripped at their ends and provided with holes for attachment to a chassis or other electronic device.

Other objects and advantages of the invention will be apparent from the remaining portion of the specification.

DETAILED DESCRIPTION

Figure 1:
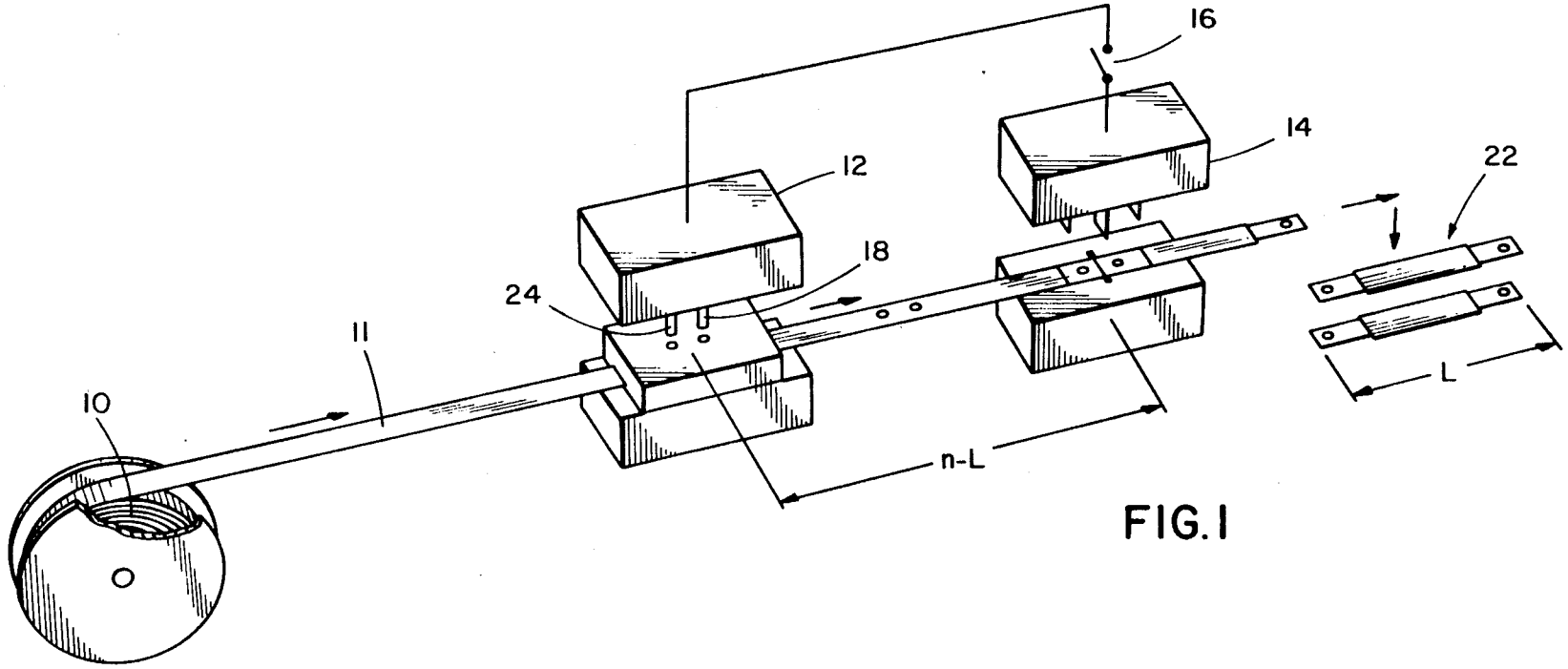
FIG. 1 is a schematic representation of the method according to the present invention.
Figure 2:
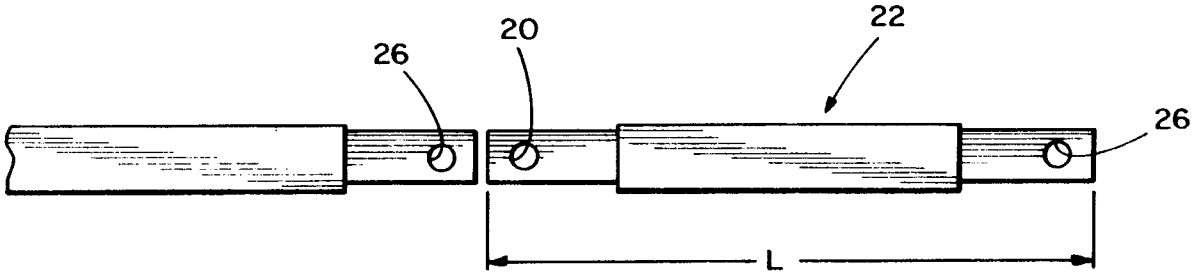
FIG. 2 is a plan view of grounding straps produced according to the invention.

Referring to the drawings and particularly FIG. 1, the method according to the invention is disclosed. A supply reel 10 has a quantity of insulated flat conductor 12 provided thereon. This conductor material may be of tin plate (tin plated steel), aluminum, copper, brass, or other flexible conductive material. The insulating material may be polyvinyl chloride, polyethylene, or similar flexible insulating material. The insulated conductor 11 is a commercially available product produced by extruding the insulation on the flat wire conductor.

In order to produce the grounding straps according to the invention, the insulated conductor 11 is passed through a punch press and a cutting a stripping machine in that order. A microswitch is provided on the cutting and stripping device for simultaneously activating the punch press for a purpose to be explained. The spacing between the cutter and stripping machine 14 and the punch press 12 is $Ln$, where $n$ is an integer and L is the length of the grounding straps being produced.

The punch press 12 perforates two holes in the conductor each time it is actuated by the microswitch 16. The punched holes are located on either side of the point at which the conductor will be severed by the cutting and stripping machine 14 due to the spacing $nL$ between the devices. Thus, punch die 18 produces the trailing hole 20 in the grounding strap 22 while punch die 24 produces the leading hole 26. The die punches 18 and 24 are designed to cut through the insulating material and the conductor to insure there is no roll over when the insulator is perforated. By known tapering techniques the die can accommodate selected hole sizes.

After the holes 20 and 26 have been punched in the continuous length of conductor 11, the conductor is passed to the cutting and stripping machine 14. The cutting and stripping machine clamps the conductor on either side of the point to be severed, which point, as indicated, is midway between the punched holes. When the conductor is securely clamped, the cutter is actuated which, in turn, activates microswitch 16 for also operating the punch press 12. The cutter 14 severs the conductor and simultaneously strips the selectable portion of insulating material from the ends of the conductor. The operation is then complete and the severed, punched and stripped grounding straps are passed to a collection area for packaging and shipment.

The punch press 12 and the cutter and stripper machine 14 are commercially available items.

By using the method of the present invention large quantities of grounding straps can be produced without the usual amount of manual labor.

While I have shown and described embodiments of this invention in some detail, it will be understood that this description and illustrations are offered merely by way of example, and that the invention is to be limited in scope only by the appended claims.

I claim:

1. A method of making an insulated grounding strap of a selected length having stripped and punched ends comprising the steps of:

a. feeding a continuous length of flexible conductor having an insulating covering from a supply reel, b. punching two holes in said conductor, one on either side of a trailing point on said conductor which is said selected length behind a leading point on said conductor, each trailing point serving as the leading point for subsequent lengths of said conductor, c. severing said conductor at each of said points, and d. stripping a desired length of insulation form the severed ends.

2. The method of claim 1 wherein the severing occurs an even multiple of the selected length after the point holes are punched and further including the sub-steps of:

a. detecting the severing of said conductor and b. performing said punching step only on detection of severing thereby assuring proper positioning of said holes on either side of the point of severance.

* * * * *